United States Patent [19]

Riedel

[11] 4,171,826

[45] Oct. 23, 1979

[54] SKI BRAKE

[75] Inventor: Tilo Riedel, Eching, Fed. Rep. of Germany

[73] Assignee: S.A. Etablissements Francois Salomon & Fils, Annecy, France

[21] Appl. No.: 936,596

[22] Filed: Aug. 24, 1978

Related U.S. Application Data

[63] Continuation of Ser. No. 666,232, Mar. 12, 1976, abandoned.

[30] Foreign Application Priority Data

Mar. 19, 1975 [DE] Fed. Rep. of Germany ..... 2512052

[51] Int. Cl.[2] ..... A63C 7/10

[52] U.S. Cl. ..... 280/605

[58] Field of Search ..... 280/605, 604, 11.11 R; 188/5

[56] References Cited

U.S. PATENT DOCUMENTS

| | | | |
|---|---|---|---|
| 3,715,126 | 2/1973 | Schwarz | 280/605 |
| 3,964,760 | 6/1976 | Riedel | 280/605 |
| 3,989,271 | 11/1976 | Riedel | 280/605 |

FOREIGN PATENT DOCUMENTS

| | | | |
|---|---|---|---|
| 984272 | 7/1951 | France | 280/605 |
| 565570 | 8/1975 | Switzerland | 280/605 |

*Primary Examiner*—David M. Mitchell

*Attorney, Agent, or Firm*—Karl F. Ross

[57] ABSTRACT

A ski brake includes a pair of elongated levers each situated at one side of a ski and pivotable between an extended and an intermediate position laterally of the ski. A free end portion of the lever engages the surface on which the ski is supported when the ski becomes detached from the ski boot. A spring arrangement urges the respective levers toward their extended positions. The levers are further mounted on the ski for angular displacement between the intermediate position and a retracted position in which the free ends of the levers are located over the upper surface of the ski so as not to interfere with the proper operation of the ski. Another spring arrangement urges the levers from their retracted to their intermediate positions when the ski boot becomes detached from the ski. The other spring arrangement includes a curved member directly or indirectly connected to the levers, the curvature of which is changed in response to attachment of the ski boot to the ski with attendant displacement of the levers into their retracted positions.

7 Claims, 10 Drawing Figures

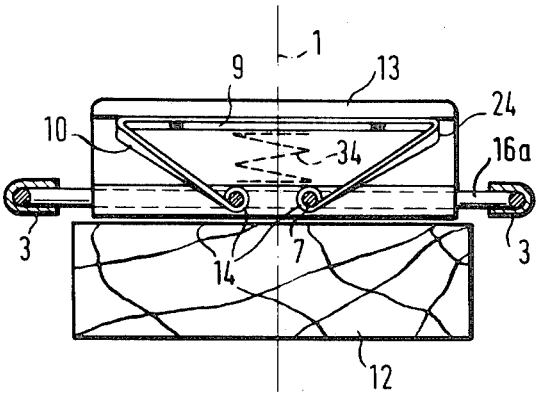
Fig. 6
Fig. 5
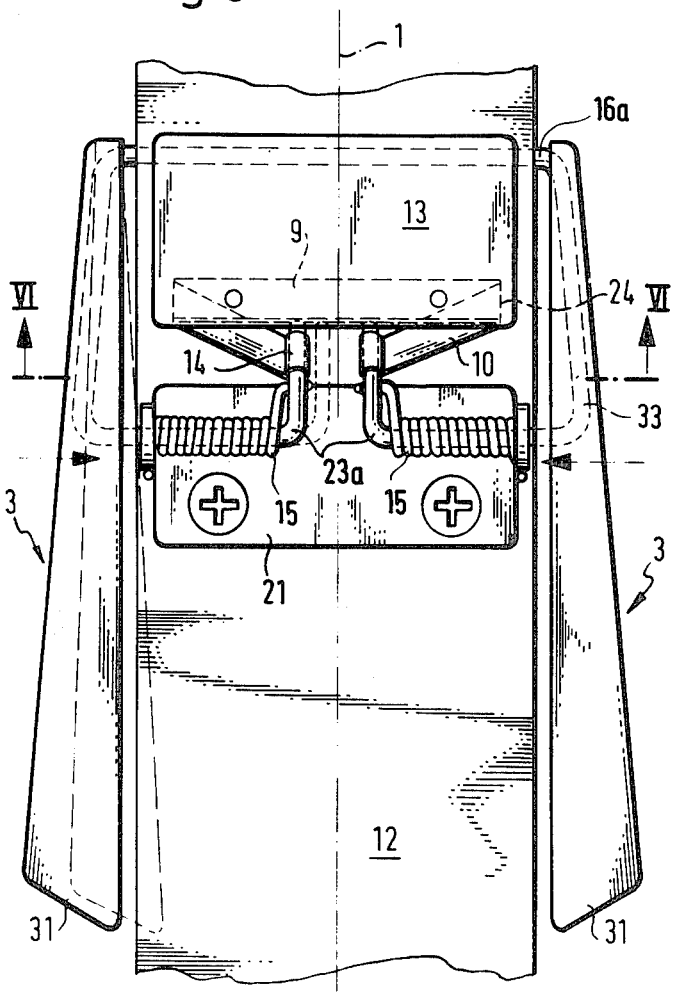
Fig. 7
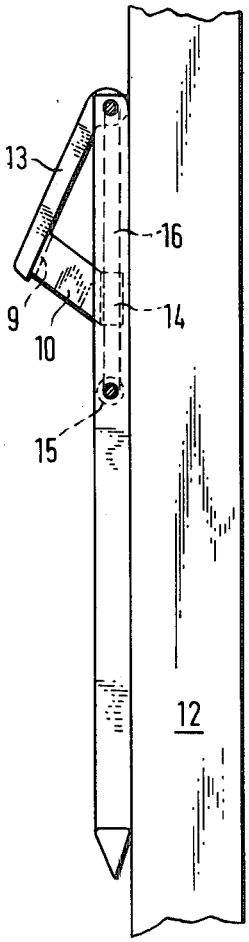

SKI BRAKE

CROSS-REFERENCE TO RELATED APPLICATIONS

This application is a Continuation of Ser. No. 666,232 filed Mar. 12, 1976, now abandoned, which in turn is related to the commonly owned patent applications Ser. No. 557,476 (now U.S. Pat. No. 3,989,271) and Ser. No. 598,628 (now U.S. Pat. No. 3,964,760).

BACKGROUND OF THE INVENTION

The present invention relates to ski brakes in general, and more particularly to such ski brakes which become active when the ski becomes detached from a ski boot to prevent or stop movement of the detached ski down the ski slope.

There are already known several constructions of ski brakes of the type here under discussion. However, experience with these conventional ski brakes has shown that, under certain circumstances, particularly when only the edge portions of the skis are in engagement with the surface of the ski slope, such as during sharp curves or sudden stops, such conventional ski brakes interfere with the proper use of the skis which may sometimes result in dangerous situations resulting from too fast a retardation of the movement of the skier over the ski slope due to the engagement of the ski brake with the possibly icy snow surface or with other objects which may be located adjacent to the path of movement of the respective ski. In addition thereto, the laterally arranged braking elements may come into contact with such objects even during the downhill movement of the skier, which results in a very hazardous situation.

SUMMARY OF THE INVENTION

Accordingly, it is a general object of the present invention to avoid the disadvantages of the prior-art ski brakes.

More particularly, it is an object of the present invention to provide a ski brake which does not interfere with the proper operation of the skis under normal skiing conditions.

Furthermore, it is an object of the present invention to provide a ski brake which is simple in construction and reliable in operation.

A concomitant object of the present invention is to provide a ski brake which reliably prevents a ski from commencing or continuing travel downhill even on a rather steep incline.

In pursuance of these objects and others which will become apparent hereafter, one feature of the present invention resides, briefly stated, in a ski brake arrangement which comprises at least one braking element having an engaging portion; means for mounting the braking element on a ski for displacement between an extended position in which the engaging portion engages a surface on which the ski is supported, an intermediate position in which the engaging portion is located laterally and upwardly of an upper surface of the ski, and a retracted position in which the engaging portion is located directly over the upper surface of the ski; and means for urging the braking element toward the extended position thereof.

In a currently preferred embodiment of the present invention, the braking element is an elongated lever which has the above-mentioned engaging portion at one end thereof and further has a mounting portion and an actuating portion. In this embodiment, the urging means includes at least one first spring element which biases the lever toward the extended position thereof, and at least one second spring element which biases the actuating portion from the retracted toward the intermediate position of the lever in a transverse direction of the ski and in a plane parallel to the upper surface thereof. The mounting means of the present invention includes pivot means which mounts the mounting portion on the ski for pivoting about a transverse axis between the intermediate and the extended positions and for angular displacement in the above-mentioned plane between the intermediate and the retracted position. Preferably, the second spring element is a normally curved elastically yieldable member which is connected to the actuating portion and operative for angularly displacing the lever toward the retracted position thereof when the curvature of the curved member is changed as a result of attachment of a ski boot to the ski.

The advantages of this arrangement are manifold. First of all, when the lever is in its extended position, the engaging portion thereof engages the surface on which the ski is supported in a region of such surface which is lateral adjacent to the ski. Thus, when the ski becomes detached from the ski boot, such as when the skier falls and the safety binding releases the ski from the ski boot, the first spring element immediately displaces the lever into its extended position so that, when the lower surface of the ski is supported on a snow surface and the front of the ski faces downhill, which is the only situation to be worried about since the ski would not be capable of proceeding downhill otherwise, the engaging portion of the lever digs into the snow and thus either prevents downhill movement of the detached ski from the very outset, or stops such movement within a short period of time. On the other hand, when the ski is properly connected to the ski boot, the lever is not only displaced against the force exerted thereupon by the first spring element into the intermediate position, but is also angularly displaced against the force of the second spring element from the intermediate into the retracted position in which the engaging portion is located not laterally of, but rather over the upper surface of the ski so that it is prevented from engaging in surface of the snow or any objects which may be located laterally of the path of movement of the ski over the snow surface even under very difficult skiing conditions, such as during sharp turns or sudden stops. Another advantage of this arrangement is that, despite the fact that the lever pivots generally in a plane normal to the upper surface of the ski between the extended and retracted position thereof, and in a different plane substantially parallel to the upper surface of the ski during the angular displacement between the intermediate and the retracted position thereof, only a simple movement of the ski boot substantially normal to the upper surface of the ski is needed for accomplishing the rather complex displacement of the lever between the extended and the retracted position thereof.

Of course, the brake arrangement of the present invention can be used with different types of ski bindings and, depending on the construction of the ski bindings, the ski brake arrangement may be so modified or designed as to its dimensions as to be compatible with the particular ski binding with which it is to be used. So, for instance, the ski brake arrangement of the present invention can be constructed as a separate structure which operates independently of the ski binding. On the other hand, at least some components of the ski brake arrangement may be incorporated into a binding, in which instance the ski brake arrangement forms an integral part of the ski binding. While the present invention has been so far explained as incorporating a single lever, it is to be understood that in many instances two such levers will be provided, each of them mounted at one lateral side of the ski, which further improves the reliability of the ski brake arrangement.

According to one currently preferred embodiment of the present invention, the second spring element is of a curved configuration in a plane normal to the upper surface of the ski and extends between and is connected to the actuating portions of the levers. The curved member which constitutes the second spring element can be, for instance, an elastically yieldable wire element which may either be stepped on directly, or which may be provided with a step-on plate which comes into abutment with the ski boot during attachment of the ski to the ski boot. However, the curved member may also be a leaf spring, or may be constituted by several separate components which are articulated to one another for elastically yieldably changing their positions with respect to one another. In this embodiment, the actuating portions of the levers are located at the other ends of the levers which are longitudinally spaced from those ends of the levers which have the engaging portions provided thereon, and the curved member may be so connected to such actuating portions as to permit limited angular displacement of the levers with respect to the curved member in the transverse direction of the ski. This can be achieved either by interposing a pivot between the respective actuating portions and the curved member, by providing pivots between the end portions of the curved member and the remainder thereof, or by so shaping a portion of the curved member adjacent the end portion thereof as to provide a pivoting joint. The respective lever is then pivoted for movement between the extended and retracted position thereof at said mounting portion.

According to a further currently preferred embodiment of the present invention, the respective lever is mounted for the angular displacement between the intermediate and the retracted position thereof at the region of the above-mentioned other end of the lever, and the actuating portion is located intermediate the ends of the lever. In this embodiment, the respective lever is mounted on a pivot for the pivoting displacement thereof between the extended and the intermediate position thereof, and such pivot is mounted on the ski for displacement in the transverse direction of the ski. The curved member of this embodiment the end portions which are operatively connected with the actuating portions of the respective levers, and a connecting portion which interconnects the end portions of the curved member for elastic yielding of the end portions with respect to the connecting portion in the transverse direction of the ski. Preferably, the end portions enclose an acute angle with the upper surface of the ski.

The connecting portion may be, for instance, a wire of an arbitrarily selectable cross section, a step-on plate, a step-on bracket and the like.

According to a currently preferred concept of the present invention, the curved member in the latter embodiment of the invention is formed as a unit including the connecting portion and the pair of end portions, and it is made of an elastically yieldable material, such as of spring steel. Preferably, the end portions of the curved member are formed with connecting means which connects the respective end portions with the transversely displaceable pivots on which the levers are mounted for pivoting between the extended and the intermediate positions thereof, such as openings in which portions of the respective pivots are accommodated for shared movement with the end portions of the curved member. In this event, the pivots are connected to the actuating portions of the levers so that displacement of the pivots in the transverse direction of the ski results in corresponding displacement of the levers between their intermediate and retracted positions.

It is to be understood that the above-discussed pivots and pivotable connections can be constructed is any customary way, the only requirement of these pivots being that they permit the pivoting and angular displacement of the levers between their extended and retracted positions through the intermediate positions. So, for instance, at least some of the bearings which accommodate the pivots may diverge in one or more directions so as to permit the superimposition of the angular displacement on the pivoting displacement of the respective lever, or any other spatial displacements which may occur during the movement of the respective lever between the extended and the retracted position.

The novel features which are considered as characteristic for the invention are set forth in particular in the appended claims. The invention itself, however, both as to its construction and its method of operation, together with additional objects and advantages thereof, will be best understood from the followng description of specific embodiments when read in connection with the accompanying drawing.

BRIEF DESCRIPTION OF THE DRAWINGS

FIG. 5 is a top plan view of a ski brake mounted on a ski, which operates according to the principle illustrated in FIG. 2;

FIG. 6 is a cross-sectional view taken on line VI—VI of FIG. 5;

FIG. 7 is a side elevational view of the embodiment of FIG. 5;

DETAILED DISCUSSION OF THE PREFERRED EMBODIMENTS

Figure 1:
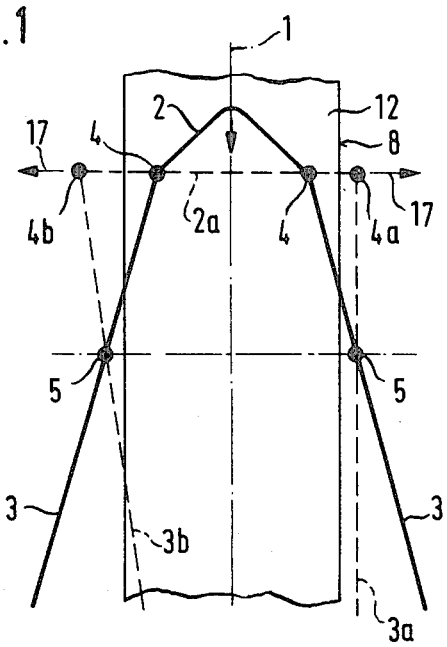
FIG. 1 is a diagrammatic view illustrating the principle of operation of a first embodiment of the present invention.
Figure 2:
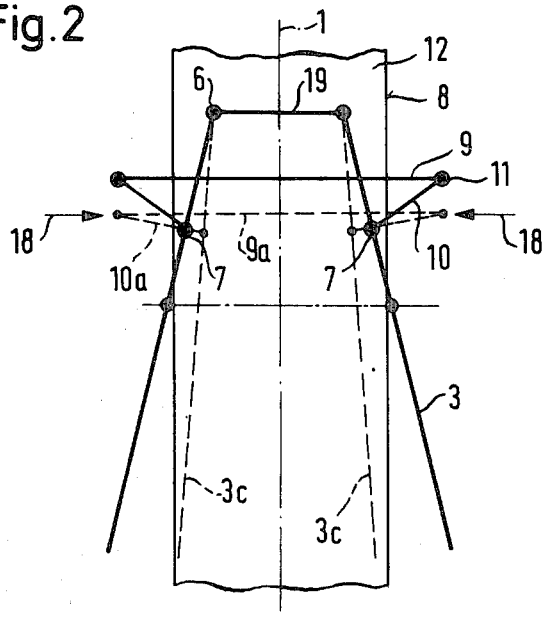
FIG. 2 is a diagrammatic view illustrating the principle of operation of a second embodiment of the present invention.

Referring now to the drawings and first to FIGS. 1 and 2 thereof, it is to be mentioned that a ski brake is to be used in connection with a ski 12. The ski is elongated and has longitudinal axis 1, a lower surface which is in contact with the surface of a layer of snow during the operation of the ski, and an upper surface on which a non-illustrated conventional ski binding is mounted. It is to be understood that the longitudinal direction conforms with the direction of the axis 1 of the ski 12, transverse direction is normal to the axis 1 and located in a plane parallel to the upper surface of the ski 12 and that "lateral" means adjacent to a side surface 8 of the ski 12. Similarly, upward and downward directions are to be understood to extend substantially normal to a plane defined by the longitudinal and the transverse directions.

Referring now particularly to the embodiment illustrated in FIG. 1, it may be seen that the reference numeral 3 indicates a braking element, such as a lever, which has a free end provided with an engaging portion. It will be more clearly explained as the discussion progresses that the respective lever 3, of which a pair is illustrated in FIG. 1, is mounted on the ski by means of a pivot 5 for displacement between an engaging position in which the engaging portion of the lever engages the surface underneath the ski in a region laterally adjacent the ski 12, and an intermediate position which is illustrated in full lines in FIG. 1 and in which the free end portion of the respective lever 3 is located above and laterally of the upper surface of the ski. The respective pivot 5 also mounts the respect lever 3 for angular displacement between the intermediate position, a partially retracted position designated in FIG. 1 with reference numeral 3*a*, and a fully retracted position illustrated in FIG. 1 in broken lines and designated with the reference numeral 3*b*. A curved member 2 extends between the other end portions of the levers 3 and is connected thereto by pivots 4. While the curved member 2 has been illustrated as being located in the plane of the drawing, it is to be understood that in reality it will extend substantially normal thereto so that, when stopped upon, it will assume a less curved configuration whereby the pivot 4 will be displaced into a position indicated by the reference numeral 4*a*, and finally a substantially straight configuration in which the pivot 4 will assume the position indicated by the reference numeral 4*b*. Thus, when the curvature of the curved element 2 changes from 2 to 2*a*, the pivots 4 will be displaced in the lateral directions of the ski 12 in the direction of the arrows 17. It may also be seen from FIG. 1 that, when the lever 3 is in its position 3*b*, the free end portion thereof is located directly above or over the upper surface of the ski 12, whereas the free end portion is laterally adjacent to the side surface 8 of the ski 12 when the lever 3 is in its positions indicated by reference numerals 3*a* and 3, respectively. Thus, the lever 3 clears the ski 12 for pivoting in an upward and downward direction and laterally of the ski 12 between the above-mentioned intermediate and extended positions.

The pivots 5 may be mounted either directly on the upper surface of the ski 12 or on the lateral extensions thereof, or even on extensions of the side surfaces 8 of the ski 12. In any event, the pivots 5 will be so constructed and the levers 3 so mounted thereon as to permit the above-mentioned pivoting and angular displacement of the levers 3 relative to the ski 12. The curved member is preferably constructed as a unit and has elastically yieldable properties so that, when the ski 12 becomes detached from a ski boot, the curved member 2 will act as a spring which will displace the levers 3 from their fully retracted positions into their intermediate positions. The curved member 2 may be a wire spring or a leaf spring, and a step-on plate separate from or a part of a ski binding may be attached thereto.

Coming now to the diagrammatic illustration of FIG. 2, it may be seen that in this embodiment the braking elements or levers 3 are to be displaced between their full-line position and their broken-line position 3*c* which correspond to the intermediate and the fully retracted positions, respectively, that is, in the direction of the arrows 18. In this embodiment, the levers 3 are also mounted, in a non-illustrated manner, on the ski 12 for pivotal displacement between the intermediate position and the extended position. Pivots 6 are located at the other ends of the levers 3 which are spaced from the free ends of the levers 3, and may be connected by a connecting element 19 with one another. The curved element of this embodiment includes a pair of end portions 10, and a connecting portion 9 which extends between and is connected to the end portions 10 for an elastically yieldable pivoting displacement of the end portions 10 with respect to the connecting portion 9. The end portions 10 may be elements separate from the connecting portion 9 and pivotally connected thereto by pivots 11 which may be spring-loaded in a sense increasing the angle between the respective end portions 10 and the connecting portion 9. However, the reference numerals 9 and 10 may also indicate different portions of a unitary curved member of an elastically yieldable material.

As also illustrated in FIG. 2, the end portions 10 enclose an acute angle with the upper surface of the ski 12 so that, when the connecting portion 9 is displaced toward the upper surface of the ski 12 as a result of, for instance, stepping either directly on the connecting element 9 or a step-on plate connected thereto, the connecting portion 9 will assume its position indicated by the reference numeral 9*a*, while the respective end portion 10 will assume the position 10*a*. Inasmuch as the levers 3 are pivoted at the pivots 6, the displacement of the connecting portions into the positions 10*a* will result in movement of the free end portion of the respective lever 3 to a retracted position directly over the upper surface of the ski 12.

Figure 3:
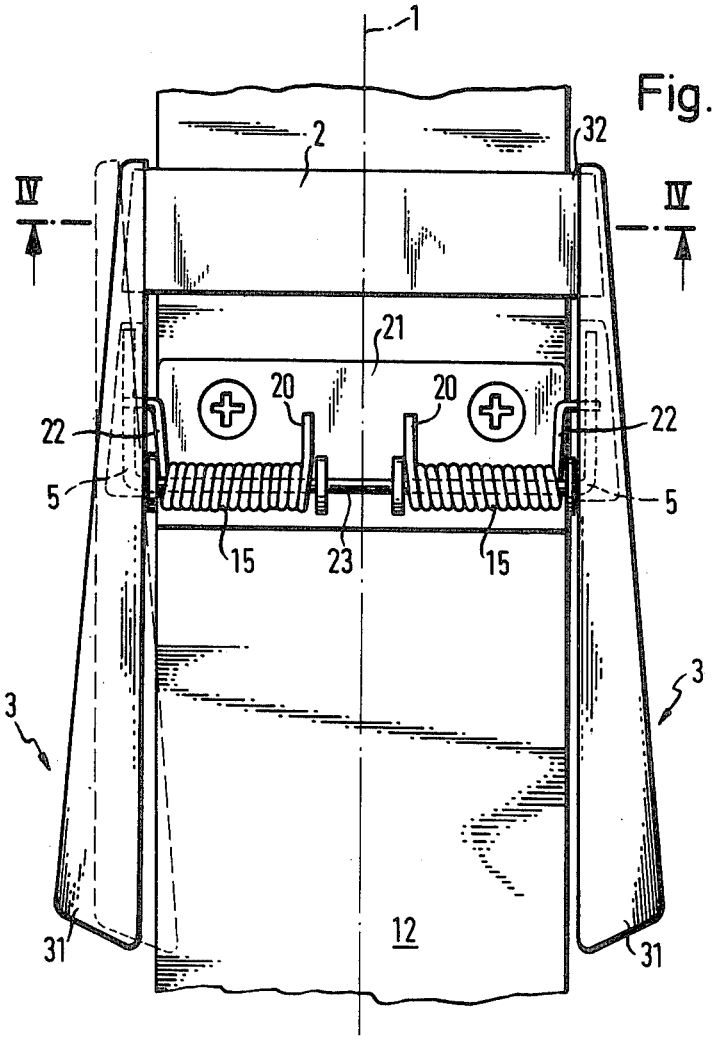
FIG. 3 is a top plan view of a ski brake mounted on a ski, which operates according to the principle of FIG. 1.
Figure 4:
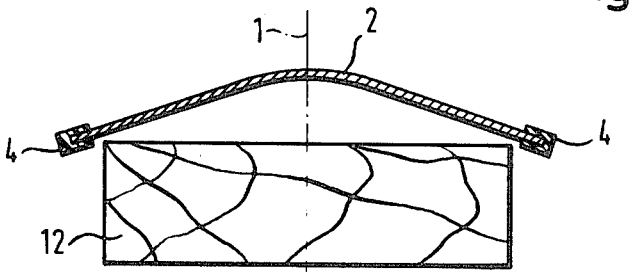
FIG. 4 is a cross-sectional view taken on line IV—IV of FIG. 3.

Having so described the principle of operation of the brake arrangement of the present invention in its two embodiments, a first construction which embodies the concept of FIG. 1 will now be discussed with reference to FIGS. 3 and 4 of the drawing. The same reference numerals have been used in all Figures of the drawing to designate similar components so as to facilitate ready comparison of the various drawings.

The braking elements 3 are configurated as elongated levers which are mounted on an axle 23 for pivoting between the aforementioned extended and intermediate positions and about pivot points 5. The curved member 2 is illustrated as having a rectangular configuration and as being curved away from the upper surface of the ski 12. During the displacement of the levers 3 between the extended and intermediate positions, the curved member 2 moves away and toward the upper surface of the ski, resting against it in the intermediate position of the levers 3 as illustrated in particular in FIG. 4. The spaced ends of the curved member 2 are received in U-shaped grooves provided in the other end portions of the levers 3 and which act as pivots 4. An abutment plate 21 is mounted on the upper surface of the ski 12, and the axle 23 is supported thereon in a conventional manner by means of bearings. A pair of springs 15 is also mounted on the axle 23, each of them having one end portion 20 which abuts against abutment plate 21, and another end portion 22 which is connected to the respective lever 3. The springs 15 urge the levers 3 toward their extended positions.

The levers 3 are illustrated in their intermediate positions in full lines, that is in such positions which are assumed when the curved member 2 abuts against the upper surface of the ski 12 but prior to deformation of the curved member 2. Now, when the curved member 2 is deformed, that is, straightened, as a result of movement of the ski boot toward the upper surface of the ski 12, the pivot points 4 are pushed outwardly of the ski 12 in the transverse direction of the ski and thus the levers 3 are angularly displaced about the pivot points 5. To render possible such angular displacement of the levers 3, a bent portion of the axle 23 is accommodated within the respective lever 3 in a diverging bearing as illustrated in broken lines. When the curved member 2 is straightened to its utmost extent, the respective lever 3 assumes the position illustrated in broken lines at the left-hand part of FIG. 3, that is, the engaging portion of the respective lever 3 is located over the upper surface of the ski 12. Thus, the lever 3 in its retracted position does not interfere with the proper operation of the ski.

Upon detachment of the ski 12 from the ski boot, the above-described operation is reversed. Thus, the curved member 2 first reassumes its bent configuration illustrated in FIG. 4 which results in angular displacement of the levers 3 into their illustrated intermediate positions, and then the springs 15 pivot the levers 3 from the intermediate positions to the extended positions thereof. In the extended positions, the engaging portions of the levers 3 engage the surface on which the ski 12 is supported, that is, for instance, the surface of the ski layer on the ski slope, and dig into it, thereby preventing unintended downhill travel of the detached ski 12.

The embodiment illustrated in FIGS. 5 to 7 illustrates a construction which embodies the principle explained above in connection with FIG. 2. Here again, the same reference numerals have been used to designate similar parts.

The curved member of this embodiment includes a unitary bracket including a connecting portion 9 and a pair of end portions 10 which are connected to the connecting portion 9 at points 24. The curved member is of an elastically yieldable material so that the curved member will have a tendency to assume the position which is illustrated in particular in FIG. 6. Here again, the levers 3 are mounted on axles **23*a* which extend transversely of the ski 12, for pivoting between a non-illustrated extended position and an intermediate position which is shown in FIGS. 5 to 7 in full lines. During this pivotal displacement, the curved member 9, 10 will be displaced away from and toward the upper surface of the ski 12. Similarly to the previously discussed embodiments, springs 15 urge the levers toward their extended positions. A step-on plate 13 is connected to the connecting portion 9 and is pivotally mounted on an axle 16*a*. The axle 16*a* and the axles 23*a* are parts of a unitary mounting element 16 which is partially embedded in the respective levers 3. The end portions 10 are provided at their free ends with arcuate receptacles 14 in which portions of the mounting element 16 are received. Now, when the step-on plate 13 is stepped upon, first the levers 3 are pivotally displaced about the axles 23*a* from the extended positions to the intermediate positions thereof against the action of the springs 15. When the end portions 10 contact the upper surface of the ski 12, further displacement of the step-on plate 13 toward the upper surface of the ski 12 results in deflection of the end portions 10 toward the connecting portion 9 so that the distance between the arcuate receptacles 14 decreases, the axles 23*a* are displaced transversely of the ski 12 into the positions illustrated in broken lines in the left-hand part of FIG. 6 and, since the mounting element 16 is embedded in the respective levers 3, the latter are displaced into their retracted positions illustrated in broken lines in FIG. 6**.

When the ski 12 becomes detached from the ski boot, the end portions 10 are first relaxed so that they move apart from one another into the position illustrated in FIGS. 5 and 6 and, subsequently thereto, the springs 15 displace the levers 3 toward their extended positions at which the levers engage the surface on which the ski is supported.

Figure 9:
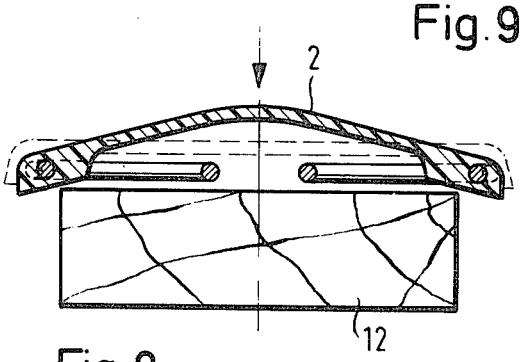
FIG. 9 is a cross-sectional view taken on line IX—IX of FIG. 8.
Figure 8:
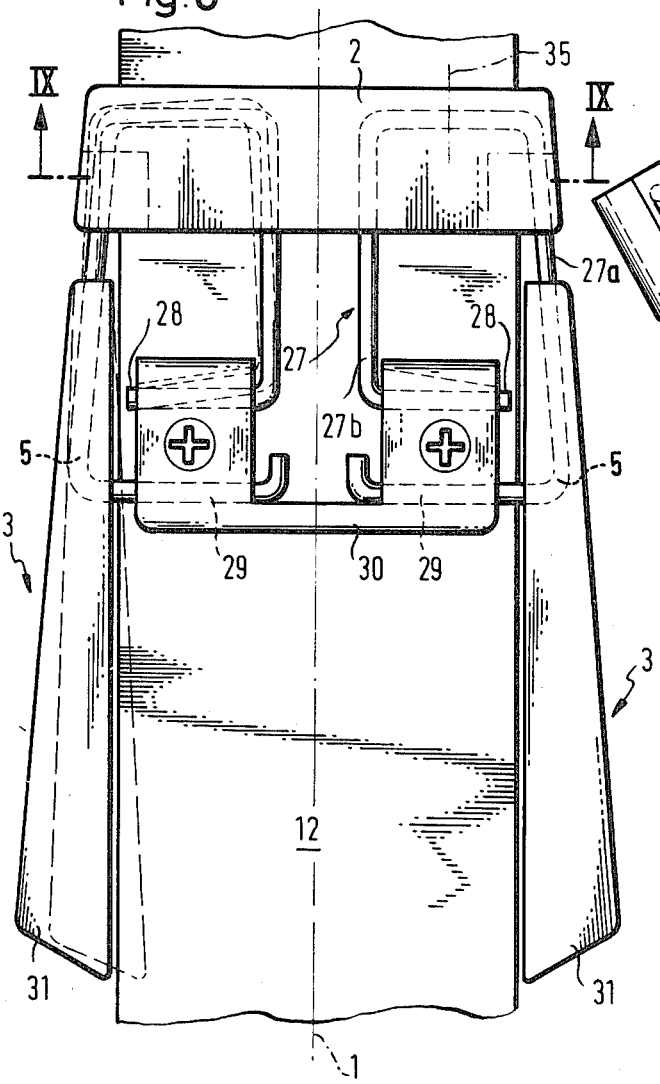
FIG. 8 is a top plan view of a further ski brake mounted on a ski, which operates according to the principle illustrated in FIG. 1.
Figure 10:
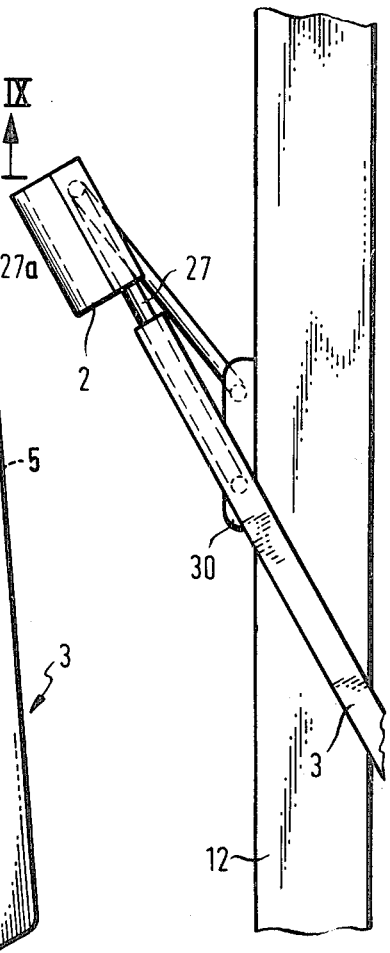
FIG. 10 is a side elevational view of the embodiment of FIG. 8.

FIGS. 8 to 10 illustrate an embodiment of the present invention which also operates according to the principle illustrated in FIG. 1. FIG. 10 illustrates the brake arrangement in its extended position in which the curved member 2 is remote from the upper surface of the ski 12. In this embodiment, a wire 27 has portions 26 which are embedded in the curved member 2 and in the levers 3, axle portions 29 supported in a bearing block 30 and end portions 28 also supported in the bearing block 30, in diverging bearings. The wire 27 is elastically yieldable so that it performs the function of the previously discussed springs 15, that is, the displacement from the intermediate position to the extended position.

When the curved member 2 is stepped upon, it is first displaced into abutment with the upper surface of the ski 12, whereby the levers 3 are pivoted about the pivot point 5 between the extended position and the intermediate position. Further pressure exerted by the ski boot on the curved member 2 results in straightening of the latter into a position illustrated in particular in FIG. 9, in broken lines, whereby the transverse dimension of the curved member 2 increases, the portions 26 of the wire 27 are forced apart and the levers 3 are thus pivoted about the pivot points 5 into their retracted positions illustrated in the left-hand part of FIG. 8 in broken lines. Simultaneously therewith, the wire 27 is deformed as also illustrated in broken lines in FIG. 8, whereby the end portion 28 moves within the bearing provided in the bearing block 30.

Upon relaxation of pressure upon the curved member 2, the latter reduces its transverse dimension so that the levers 3 return into their intermediate positions, whereupon the wire 27 further pivots the levers 3 into their extended positions.

It will be understood that each of the elements described above, or two or more together, may also find a useful application in other types of constructions differing from the types described above.

While the invention has been illustrated and described as embodied in a ski brake, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ski brake for use on aski having upper and lower surfaces and side edges and adapted to travel forwardly along the ground in a predetermined travel direction, said brake comprising:

at least one elongated braking element having an engaging portion, an actuating portion longitudinally spaced therefrom, and a mounting portion between said actuating and engaging portions;

pivot means between said mounting portion and said ski for mounting said element at one of said side edges and for defining for said element on said ski a horizontal pivot axis generally transverse to said direction and generally parallel to said surfaces and an upright pivot axis transverse to said surface and to said direction, said element being displaceable about said horizontal axis relative to said ski between an extending braking position with said engaging portion projecting downwardly past said lower surface and an intermediate position with said element lying wholly above said upper surface and said engaging portion spaced laterally outwardly of said side edge, said element further being displaceable about said upright axis between said intermediate position and a retracted position with said engaging portion overlying said upper surface;

spring means between said ski and said element for urging same into said braking position;

an abutment spaced laterally on said ski from said actuating portion; and means including an elastically yieldable member curved in a transverse plane and connected between said actuating portion and said abutment for pivoting said element about said upright axis to displace same into said retracted position on flattening of said member by a skiboot.

2. The ski brake defined in claim 1 wherein in said intermediate position said yieldable member is concave downwardly toward said upper surface.

3. The ski brake defined in claim 1, further comprising a second such element, pivot means, and spring means on said ski laterally adjacent the first-mentioned element on the other side edge, the actuating portion of said second element being connected to said yieldable member and constituting said abutment.

4. The ski brake defined in claim 3 wherein said spring means each include a torsion spring having one leg bearing on said ski and another leg bearing on the respective element.

5. The ski brake defined in claim 3 wherein said elements each include a wire having one leg forming the respective horizontal axis and another leg extending longitudinally between the respective mounting portion and at least one of the other respective portions, said wires each being bendable between the respective legs about the respective upright axes.

6. The ski brake defined in claim 5 wherein said elements each include an elongated synthetic-resin bar in which the respective other leg of the respective wire is embedded.

7. The ski brake defined in claim 3 wherein said horizontal axes are coaxial.

* * * * *